US006035504A

United States Patent [19]

Görgen

[11] Patent Number: 6,035,504

[45] Date of Patent: Mar. 14, 2000

[54] DEVICE FOR FOLDING THE EDGES OF ROOF CUTOUTS FOR MOTOR VEHICLE SLIDING ROOFS

[75] Inventor: Josef Görgen, Weiskirchen, Germany

[73] Assignee: Thyssen Industrie AG, Essen, Germany

[21] Appl. No.: 09/142,285

[22] PCT Filed: Apr. 17, 1997

[86] PCT No.: PCT/EP97/01923

§ 371 Date: Sep. 2, 1998

§ 102(e) Date: Sep. 2, 1998

[87] PCT Pub. No.: WO97/44148

PCT Pub. Date: Nov. 27, 1997

[30] Foreign Application Priority Data

May 21, 1996 [DE] Germany ..... 196 20 247

[51] Int. Cl.[7] ..... B23P 11/00

[52] U.S. Cl. ..... 29/243.5; 29/243.57

[58] Field of Search ..... 29/243.5, 243.57, 29/243.58, 509

[56] References Cited

U.S. PATENT DOCUMENTS 5,189,784 3/1993 Welty ..... 29/243.5
5,224,253 7/1993 Sawa ..... 29/243.5
5,237,734 8/1993 Polon ..... 29/243.5

FOREIGN PATENT DOCUMENTS 44 12 232 A1 10/1995 Germany .
44 18 684 A1 11/1995 Germany .
6 170 459 6/1994 Japan .

*Primary Examiner*—David A. Scherbel
*Assistant Examiner*—Daniel Shanley
*Attorney, Agent, or Firm*—McGlew and Tuttle, P.C.

[57] ABSTRACT

The application relates to a device for folding the edges of roof cutouts for motor vehicle sliding roofs in which the coachwork has an outer (1) and an inner (3) panel, each with an upwardly projecting flange (2, 4) limiting the roof cutout and the flange of the outer panel is wider than that of the inner panel. In a device for folding the edges of the cutout for sliding roofs, there is a fold bed (5) as the support for the outer panel and the inner panel arranged thereon, an abutment (8) on the side of the roof cutout for the flange of the outer panel and the flange of the inner panel bearing thereon, a filler slide (9) arranged above the fold bed and movable against the abutment or the flange and a multi-component folding slide, the folding slide components (14, 16) of which can be moved both parallel and perpendicularly to the plane of the roof cutout, and have folding strips (19) to engage and fold the section of the flange of the outer panel projecting beyond the flange of the inner panel.

14 Claims, 4 Drawing Sheets

DEVICE FOR FOLDING THE EDGES OF ROOF CUTOUTS FOR MOTOR VEHICLE SLIDING ROOFS

FIELD OF THE INVENTION

The invention relates to a device for folding the edges of roof cutouts for motor vehicle sliding roofs in which the coachwork has an outer and an inner metal plate, each with an upwardly projecting flange limiting the roof cutout and in which the flange of the outer metal plate is wider than that of the inner metal plate.

BACKGROUND OF THE INVENTION

The outer metal plate of the coachwork is connected to the inner metal plate by folding the flange section of the outer metal plate which projects beyond the upwardly standing flange of the inner metal plate over the flange of the inner metal plate. It takes two work cycles, that means edging by 90° and subsequent folding; in practice these two work cycles are executed with different devices or, if required, by hand, calling for extensive manipulation of the coachwork metal plate.

Previously known from DE 44 18 684 A1 and DE 44 12 232 A1 are bordering processes and corresponding bordering devices for preliminary and finish bordering of coachwork parts, where a radially movable slide to establish a bordering union is provided at a pressing tool, the pre-bordering edge of which can be moved towards the outside to execute the subsequent finish bordering. Here, too, a bordering union of the parts is effected in a first transformation phase of the pressing tool by means of a pre-bordering edge of a movable slide; subsequently the slide moves radially towards the outside. In a second transformation phase of the pressing tool a second bordering tool with a bordering edge effects a finish bordering of the parts to be united.

SUMMARY AND OBJECTS OF THE INVENTION

It is the primary object of the invention to execute the 90° edging and subsequent folding of edges of roof cutouts for sliding roofs in one device.

This task is solved by a device of the species described above which is characterized by a folding bed serving as support for the outer metal plate and for the inner plate arranged upon it and an abutment arranged at the side of the roof cutout. The abutment serves for the flange of the outer metal plate and the flange of the inner metal plate resting against it. A filling slide is arranged over the folding bed and movable against the abutment and/or flanges, a multiple-part folding slide, the folding slide part of which can be moved both parallel to the plane of the roof cutout and orthogonally to it, each provided with folding strips to engage and fold the section of the flange of the outer metal plate projecting beyond the flange of the inner metal plate.

For folding of edges of a roof cutout for sliding roofs of motor vehicle coachworks (body) the outer metal plate provided with an upwardly projecting flange limiting the roof cutout is laid on the folding bed. The inner metal plate which is also provided with an upwardly projecting edge is laid on it. The flange of the outer metal plate finds its support in the abutment. The flange of the inner metal plate is held with the filling slide against the flange of the outer metal plate and thus against the abutment. Then the folding slide parts will be so adjusted that the undersides of their folding strips are mainly flush with the upper edge of the upwardly projecting flange of the inner metal plate and plate thickness of the outer metal plate and the folding slide parts will be so moved that the outer metal plate flange section projecting beyond the flange of the inner plate is initially folded by approximately 90° beyond the upper edge of the flange of the inner plate. Subsequently the filling slide will be removed and/or so moved that the folding slide parts are moved parallel to the upwardly projecting flange of the inner metal plate, thus folding the projecting flange section already folded by 90° parallel to the flange of the inner metal plate.

In a preferred layout of this invention the folding bed has got a recess corresponding to the roof cutout and is arranged in the recess of the annular-shaped abutment. For assembly considerations it can be expedient to have an abutment that can be moved orthogonally to the plane of the roof cutout in the recess.

The filling slide may also be of a multi-component structure, with the filling slide parts being mainly movable in parallel to the plane of the roof cutout. It is recommendable to apply a layout in which the filling slide parts are arranged along the straight edges of the roof cutout and are movable towards the roof cutout. Besides, the filling slide parts should extend along the straight edges up into the corner areas of the roof cutout and have side areas at least in some sections which are arranged at an angle of 45°. Thus it is ensured that the flanges of the outer and inner metal late are sufficiently held in the comer areas between the abutment and the filling slide parts, too.

To ensure that the first folding procedure, that means the folding of the projecting flange section of the outer metal plate by 90' proceeds in a defined manner, it is advantageous for the filling slide parts to have an edge strip at the roof cutout side serving as folding abutment for the folding strips of the folding slide parts. These edge strips are removed together with the filling slide parts prior to the start of the second folding procedure.

In a preferable layout of this invention the folding slide parts are arranged in the area of and over the recess, on the one hand there being folding slide parts belonging to the folding slide which extend along the straight sections of the roof cutout and which are movable towards the roof cutout, and on the other hand there being folding slide parts which are allocated to the corner areas of the roof cutout and which are movable towards the straight edges of the roof cutout at an angle of approx. 45°. To prevent the filling slide parts on the one hand and/or the folding slide parts on the other hand from obstructing each other during the folding procedures, the filling slide parts and/or folding slide parts should at least be movable independently of each other in parallel to the plane of the roof cutout. It is understood that appropriate drives are allocated to the filling slide parts and folding slide parts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
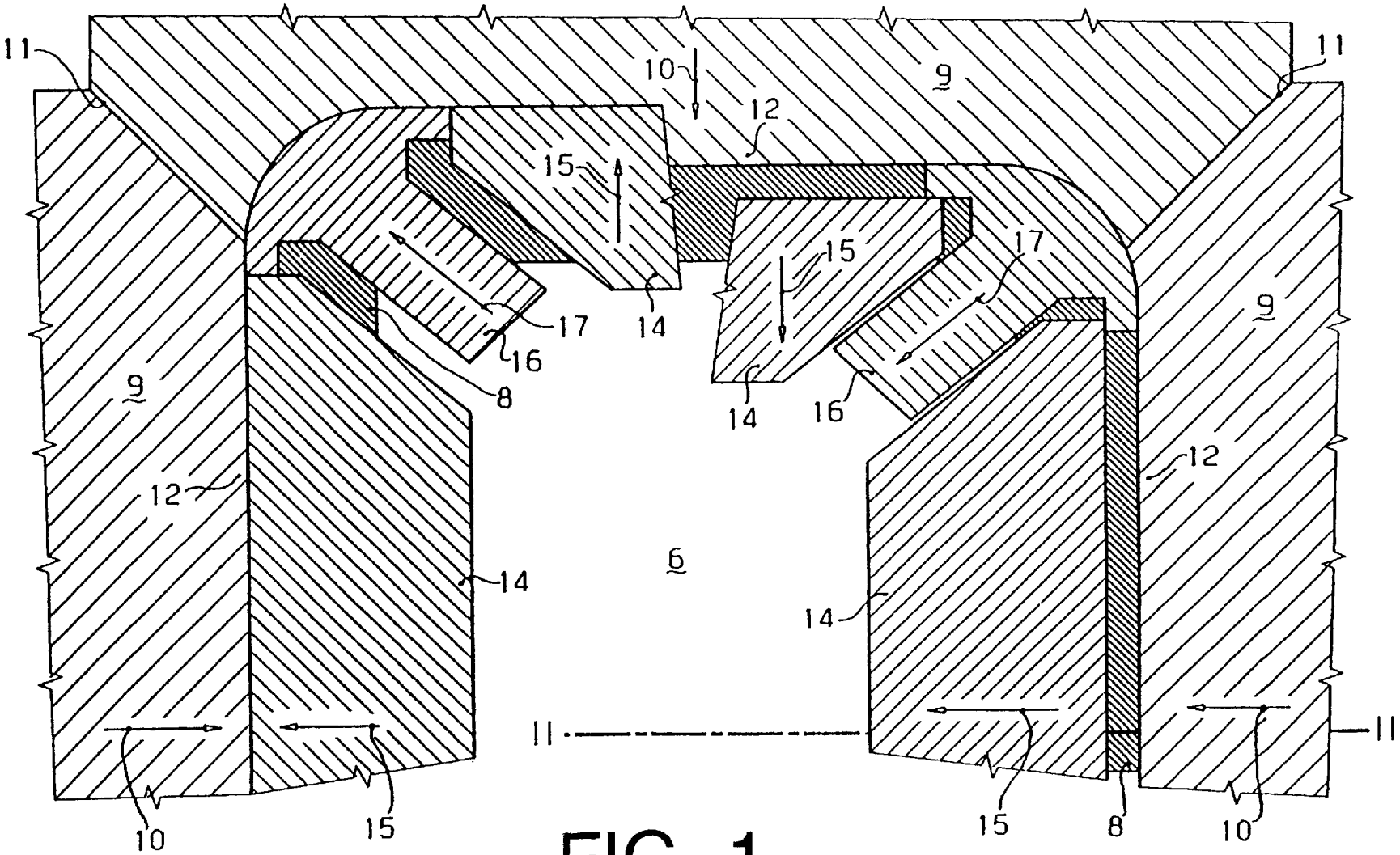
FIG. 1 is a schematic view and partially a top view on the device being the subject of this invention, wherein the left and right half of this figure reflect different function positions.

Referring to the drawings in particular, the device shown is provided for folding of edges of roof cutouts for sliding roofs of motor vehicle bodies (coachworks). The vehicle body has got an outer metal plate 1 with a upwardly projecting flange 2 limiting the roof cutout and an inner metal plate 3 with a flange 4 bearing on it. Flange 2 of the outer metal plate 1 is wider than flange 4 of the inner metal plate 3 (see FIGS. 2, 3 and 4).

The device is furthermore comprised of a folding bed 5 serving as support for a periphery area of the outer metal plate 1 and a periphery area of the inner metal plate 3 arranged upon it. The folding bed 5 has got a recess 6 corresponding to the roof cutout. Located in this recess 6 in the direction of arrow 7 and movable by a drive not shown in the figures there is a ring-shaped abutment 8. The ring-shaped abutment 8 is for the flange 2 of the outer metal plate 1 and the flange 4 of inner metal plate 3 to rest against it.

Arranged above the folding bed 5 is a multiple-part filling slide with filling slide parts 9. The filling slide parts 9 are movable in the direction of arrows 10 by drives not shown here. The filling slide parts 9 extend along the straight edges of the roof cutout up and into the corner areas of the roof cutout, terminating at the side areas 11 extending at an angle of 45° so that flanges 2 and/or 4 are also held and/or there is restraint in the corner areas of the roof cutout between the filling slide parts 9 and the abutment 8. The filling slide parts 9 moreover have got an edge strip 12 at the side of the roof cutout. The upper side 13 of the edge strip 12 is flush with the upper edge of flange 4 of inner metal plate 3 so that the upper side 13 forms a folding abutment.

Figure 4:
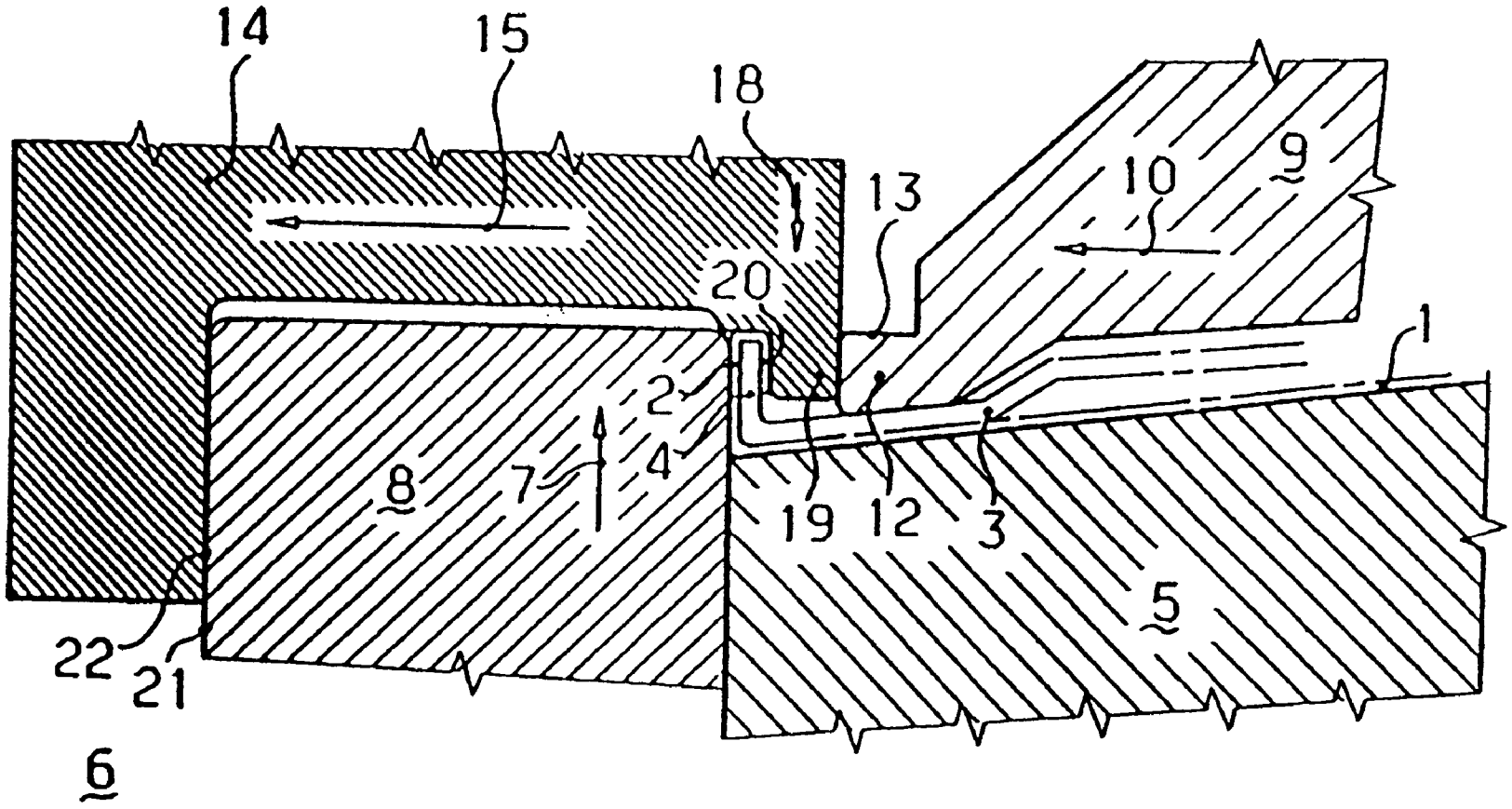
FIG. 4 is another sectional view showing a function position of the object according to FIG. 2.

In the area of the recess 6 and above recess 6 there is multiple-part folding slide with folding slide parts 14 extending along the straight sections of the edges of the roof cutout and which are movable by drives not shown here in the direction of arrows 15. On the other hand the folding slide is composed of folding slide parts 16 which are allocated to the corner areas of the roof cutout and which are movable by non-shown drives in the direction of arrows 17 at an angle of 45° towards the straight edges of the roof section. The folding slide parts 14 and 16 are moreover movable by non-shown drives orthogonally to the plane of the roof cutout in the direction of arrow 18 (FIG. 4). Besides the folding slide parts 14, 16 are equipped with a folding strip 19 each at their undersides.

Figure 2:
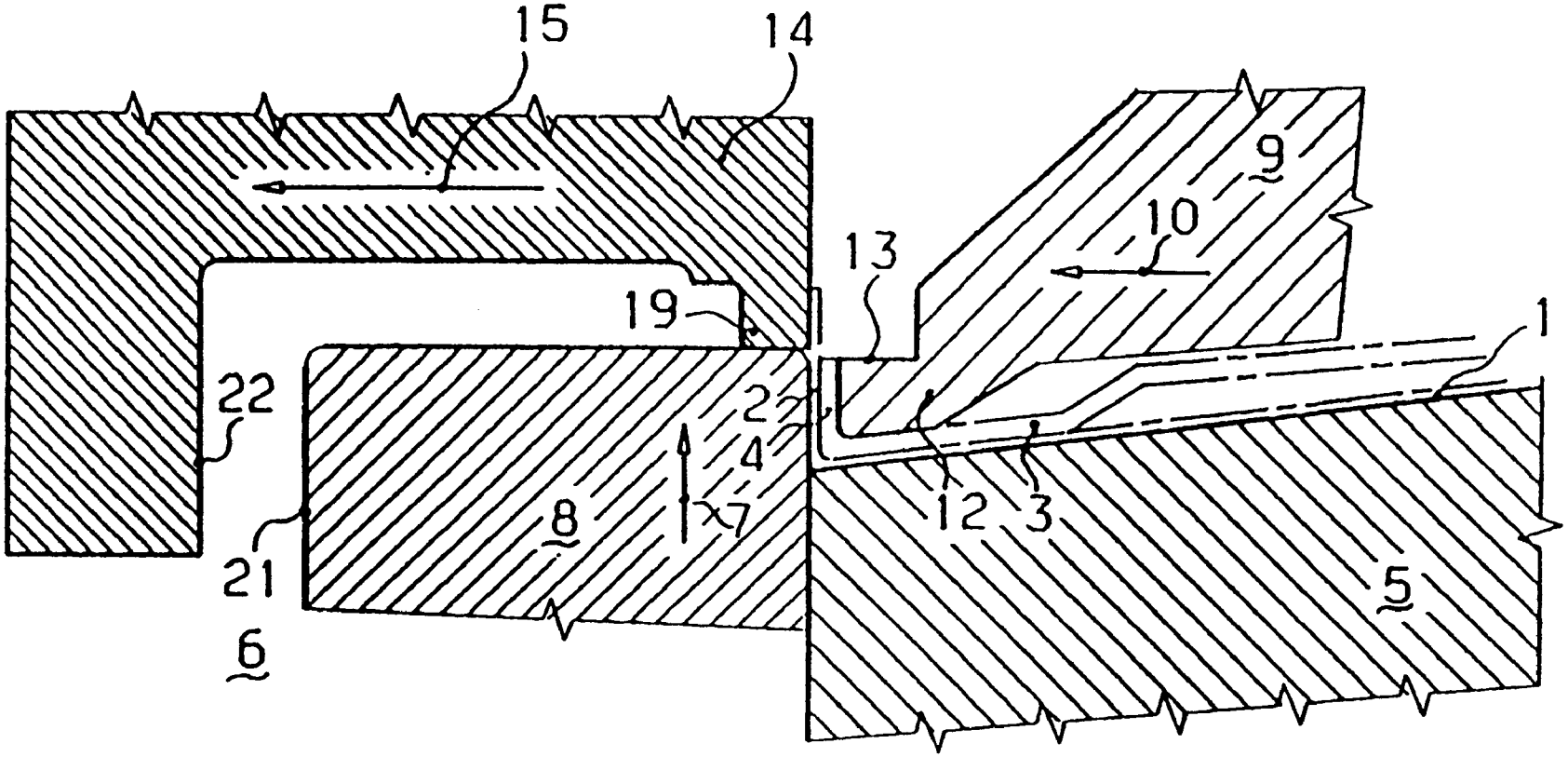
FIG. 2 is a sectional view in direction I–II through the object according to FIG. 1.
Figure 3:
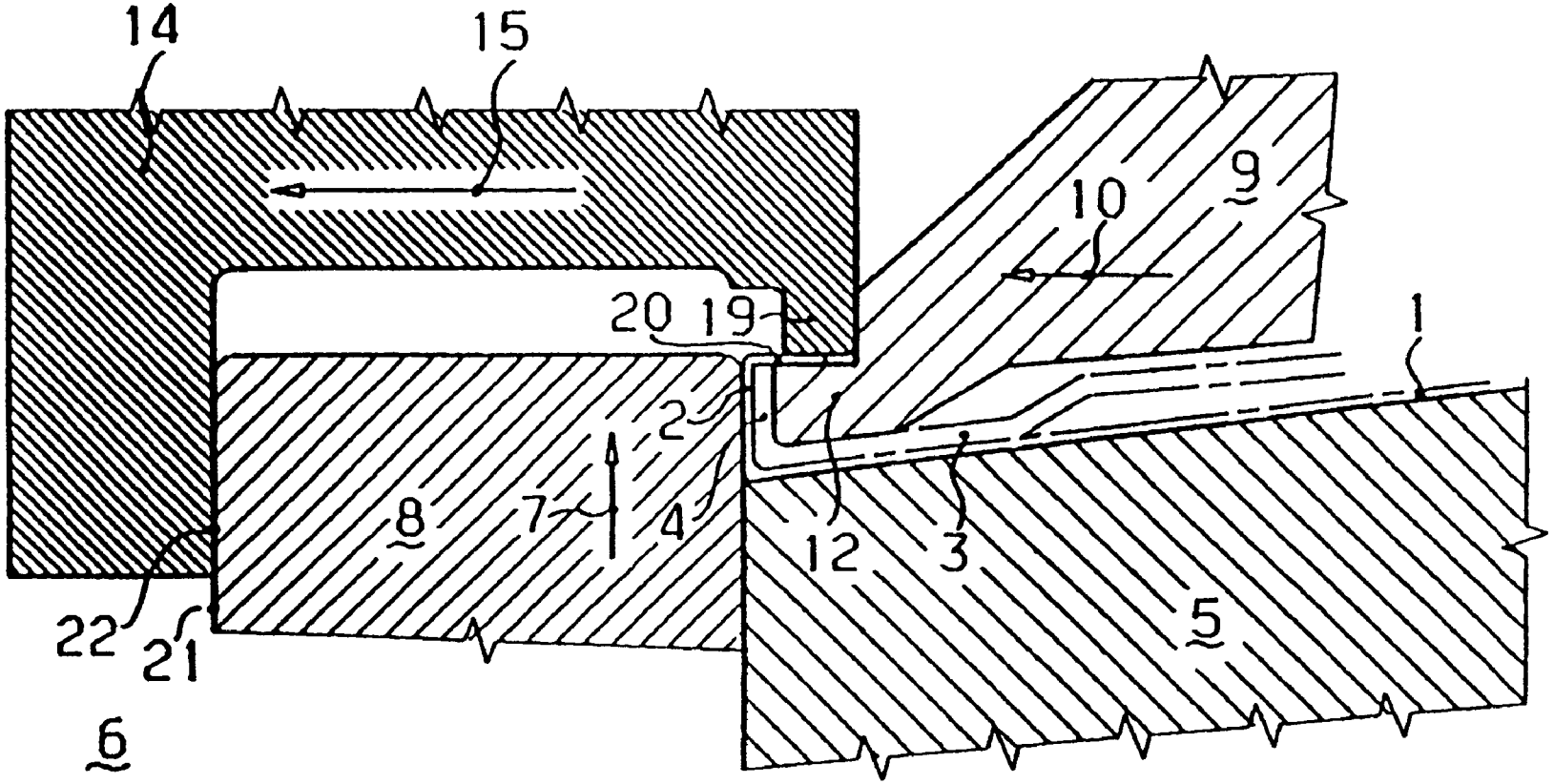
FIG. 3 is another sectional view showing a function position of the object according to FIG. 2, in conformity with the representation of the left half of FIG. 1.

The device shown works as follows: the outer metal plate 1 is laid onto the folding bed 5 so that a flange 2 defining the roof cutout is mainly flush with the recess 6. The abutment 8 may already have been moved upwardly or be moved upwardly subsequently. Then the inner metal plate 3 is so laid onto the outer metal plate 1 that its flange 4 rests against flange 2 of the outer metal plate 1. Then the filling slide parts 9 are moved in the direction of arrows 10 against flanges 2,4 so that the flanges 2,4 are restrained between abutment 8 and the filling slide parts 9. The folding slide parts 14, 16 are located above recess 6 and in the layout shown here they rest with their folding strips 19 on the upper side of abutment 8 (FIG. 2). Then the folding slide parts 14, 16 are moved by the drives allocated to them outwardly in the direction of arrows 15, 17, thus folding the flange section 20 projecting beyond flange 4 of inner metal plate 3 by approximately 90° on the upper side 13 of the edge strip 12 of the filling slide parts 9 (FIG. 3).

In a further work step shown in FIG. 4 the filling slide parts 9 are moved back in the direction of arrow 10, that means in the layout shown here roughly by the width of folding strips 19. Then the folding slide parts 14 are moved downwardly in the direction of arrow 18, folding the projecting flange sections 20 of the outer metal plate 1 closely around flange 4 of the inner metal plate 3.

In the layout shown here an area 21 of abutment 8 directed towards recess 6 forms a guide for allocated areas 22 of the folding slide parts 14, 16.

While a specific embodiment of the invention has been shown and described in detail to illustrate the application of the principles of the invention, it will be understood that the invention may be embodied otherwise without departing from such principles.

What is claimed is:

1. A device for folding the edges of roof cutouts for motor vehicle sliding roofs in which the vehicle body has an outer and an inner metal plate, each with an upwardly projecting flange limiting the roof cutout wherein the flange of the outer metal plate is wider than the flange of the inner metal plate, the device comprising:

a folding bed providing support for the outer metal plate and the inner metal plate bearing on the outer metal plate;

an abutment positionable against the flange of the outer metal plate and the flange of the inner metal plate resting against the flange of the outer metal plate;

a filling slide movable against the abutment and/or flanges; and a multiple-part folding slide with folding slide parts which are movable both in parallel to a plane of the roof cutout and orthogonally to the plane of the roof cutout, said folding slide parts having folding strips each to engage and fold a section of the flange of the outer metal plate projecting over flange of the inner metal plate.

2. The device according to claim 1, wherein the folding bed has a recess corresponding to a roof cutout and said abutment is a ring-shaped abutment located in said recess.

3. The device according to claim 1 wherein said abutment is orthogonally movable to the plane of the roof cutout.

4. The device according to claim 1, wherein said filling slide includes a plurality of filling slide parts movable in parallel to the plane of the roof cutout.

5. The device according to claim 4, wherein said filling slide parts are located along the straight edges of the roof cutout and are each movable towards the roof cutout.

6. The device according to claim 4, wherein said filling slide parts extend along straight edges up and into corner areas of the roof section and have side areas at least in some areas which are arranged at an angle of about 45°.

7. The device according to claim 4, wherein said filling slide parts have an edge strip at the side of the roof cutout serving as a folding abutment for the folding strips of said folding slide parts.

8. The device according to claim 1, wherein said folding slide parts are located in an area of and above said recess.

9. The device according to claim 1, wherein said folding slide includes a first set of folding slide parts which extend along straight sections of edges of the roof cutout and which are movable each towards the roof cutout, and said folding slide includes a second set of folding slide parts allocated to corner areas of the roof cutout and which are movable at an angle of about 45° to the straight edges of the roof cutout.

10. The device according to claim 1, wherein said filling slide includes filling slide parts, and wherein one of said filling slide parts and said folding slide parts are at least movable independently of each other in parallel to the plane of the roof cutout.

11. The device according to claim 2 wherein said abutment is orthogonally movable to the plane of the roof cutout.

12. A device for folding the edge of a cutout in first and second plates, each plate having a periphery area and a flange limiting the cutout, each flange having an inner side facing the cutout and an outer side facing away from the cutout, the device comprising:

a folding bed providing support for the periphery area of the first plate, and the periphery area of the second plate bearing on the periphery area of the first plate;

an abutment positionable against the inner side of the flange of the first plate with the inner side of the flange of the second plate resting against the outer side of the flange of the first plate;

a filling slide movable against the outer side of the flange of the second plate;

a multiple-part folding slide with folding slide parts which are movable both substantially parallel to a plane of the cutout and orthogonally to the plane of the cutout, each of said folding slide parts having folding strips to engage and fold a section of the flange of the first plate over and around the flange of the second plate with the outer side of the flange of the first plate pressed against the outer side of the flange of the second plate.

13. The device according to claim 12, wherein:

said folding slide includes a first set of folding slide parts extending along straight sections of edges of the cutout and which are movable towards the cutout, and said folding slide includes a second set of folding slide parts allocated to corner areas of the cutout and which are movable at an angle of substantially 45° to the straight edges of the cutout.

14. The device in accordance with claim 12, wherein:

the plates are inner and outer metal plates of a roof of a motor vehicle;

the cutout is a roof cutout for a sliding roof.

* * * * *